299-13
FIP7811 XR 4,063,780

United States Patent [19]
Zvejnieks

[11] 4,063,780
[45] Dec. 20, 1977

[54] METHOD OF RECOVERING LIQUID AND GASEOUS PRODUCTS OF OIL SHALE

[75] Inventor: Andrejs Zvejnieks, Atlanta, Ga.

[73] Assignee: AZS Corporation, Atlanta, Ga.

[21] Appl. No.: 653,907

[22] Filed: Jan. 30, 1976

[51] Int. Cl.[2] ..... E21B 43/24; E21C 41/10
[52] U.S. Cl. ..... 299/2; 166/259; 299/13
[58] Field of Search ..... 299/2, 13; 166/256, 166/259, 272; 48/122

[56] References Cited

U.S. PATENT DOCUMENTS

| | | | |
|---|---|---|---|
| 1,913,395 | 6/1933 | Karrick | 299/2 |
| 1,919,636 | 7/1933 | Karrick | 299/2 |
| 3,291,215 | 12/1966 | Nichols | 166/259 |
| 3,434,757 | 3/1969 | Prats | 299/2 |
| 3,915,498 | 10/1975 | Burton et al. | 299/2 |
| 3,917,344 | 11/1975 | Janssen et al. | 299/2 |
| 3,980,339 | 9/1976 | Heald et al. | 299/13 X |

FOREIGN PATENT DOCUMENTS

| | | | |
|---|---|---|---|
| 734,719 | 4/1943 | Germany | 166/256 |

*Primary Examiner*—Stephen I. Novosad
*Assistant Examiner*—George A. Suchfield
*Attorney, Agent, or Firm*—Patrick F. Henry

[57] ABSTRACT

A method of processing oil shale to recover liquid or gaseous products which comprises constructing longitudinally sloping trenches excavated in a mineral deposit which is relatively impermeable in relation to the crushed oil shale, placing the crushed shale into the sloping trenches and covering same with a compacted layer of clay or other relatively impermeable and essentially inorganic minerals and thereafter igniting the oil shale at the upper end of the trench. Air is introduced at points along the upper end of the trenches and as the retorting zone moves longitudinally downward in the sloping trenches the liquid and gaseous materials are withdrawn at points located at the lower end of the trenches.

15 Claims, 9 Drawing Figures

METHOD OF RECOVERING LIQUID AND GASEOUS PRODUCTS OF OIL SHALE

BACKGROUND OF THE INVENTION

1. Field of the Invention

Generally methods for recovering oil and oil products and more particularly the mining of oil shale and subsequent recovery of oil and oil products.

2. Description of the Prior Art

The rich oil shale deposits located in the United States on the Western slope of the Rocky Mountains constitute a potential source of fuel several times as great as the total identified reserves of U.S. oil. Similar deposits of oil shale occur also in other parts of the world, and many processes have been developed utilize this huge potential for production of fuels and chemicals. Nevertheless, the economics of recovering oil or other valuable products from oil shale is something else. Consequently, at this time, viable oil shale industries exist only in Estonia and the Peoples Republic of China.

Oil shale is a highly consolidated rock composed of a complex mixture of organic and inorganic constituents. The organic material is solid and only slightly soluble in common solvents at ambient temperature and pressure. To produce liquid and gaseous fuels, oil shale must be mined, crushed to appropriate size and heated to sufficiently high temperatures at which pyrolysis of the solid organic material occurs.

Methods have been developed to pyrolise oil shale in above-ground retorts by:

A. Direct heating by hot gases from combustion within the retorting vessel (Bureau of Mines Gas Combustion Retort and Union Oil Company of California Retort A)

B. Heat transfer from an externally heated carrier fluid (Union Oil Company of California Retort B and Cameron & Jones Vertical Kiln)

C. Heat transfer from recycled hot solids (TOSCO Process and Lurgi-Ruhrgas Process).

Unfortunately, none of these processes are in commercial scale operation, because the economics of mining and crushing of oil shale, retorting it in these above ground retorts and disposing of the inorganic residue are still under question.

Attempts have also been made to develop "in situ" retorting methods. Such "in situ" oil recovery experiments were designed and conducted by Burwell, Sterner and Carpenter 1970, and by Carpenter 1972. Both of these experiments were based on the concept of igniting the shale in an injection well and forcing gases and liquids horizontally through fractures to several recovery wells surrounding the injection well. The combustion was sustained by pumping compressed air through the injection well to the fractured oil shale formation. Analysis of the results and evaluation of the fracture system indicate that insufficient surface area was available to sustain high enough reaction rates to produce liquid products.

Garrett Research and Development Company has developed a modified "in situ" process which seems to be a combination of above ground and "in situ" retorting processes. As described by Ridley, this process consists of creating underground "chimneys" of tightly packed but broken oil shale by mining the required void volume and subsequent breakage of overlying oil shale by the use of conventional explosives. Connections are made to both the top and bottom and retorting is carried out. Air is circulated downward through the rock pile and combustion is initiated at the top with the aid of an outside fuel source for a matter of hours. The heat released retorts the top shale to produce shale oil, some gas, and residual carbon left on the shale. This carbon then becomes part of the required fuel. Part of the off-gas is recirculated to control the oxygen concentration in the incoming air and this gas provides needed additional fuel. The oil flows or drains to the bottom of the retort where it is collected in a sump and pumped to underground storage. The gas not recycled is burned with a potential for power generation significantly in excess of the plant's needs. Furthermore, Ridley states that "The critical questions related to process feasibility have all been answered affirmatively and the emphasis is now on scaleup to commercial site underground retorts. We will, in 1974, prepare a 250 foot high retort with breadth and width of over 100 feet each."

It appears that the aforementioned Garrett Research and Development Company system still has not overcome at least three serious problems. For the first, when practicing the teaching, a substantial amount of the oil shale still would have to be mined and retorted or disposed by conventional above ground methods. For the second, the topography of oil shale deposits is such that this mineral is deposited in essentially horizontal or only slightly sloping layers. The average thickness of such layers considered as commercial deposits is 10–100 feet. Such a topography generally does not lend itself to excavation of large enclosed underground chimneys. For the third, it has been determined by others that crushed oil shale tends to lose its permeability if exposed to simulated overburden pressure at retorting temperatures. It is likely that the essentially horizontal retorting zone in Garrett's underground chimney of tightly packed but broken oil shale would be exposed to such overburden pressures which could result in loss of permeability and/or by-passing in some areas.

SUMMARY OF THE INVENTION

An object of the present invention is to provide a method which is suitable for crushing and "in situ" retorting of horizontal or sloping layers of oil shale.

Another object of this invention is to provide a "semi in situ" method for retorting of the oil shale which has been mined to create the required void volume in said horizontal or sloping layers of oil shale.

An advantage of this invention is that it provides for a retorting zone which is closer to vertical and consequently less sensible to the overburden pressure.

Other and further objects and advantages of this invention will become apparent upon reading the following specification taken in conjunction with the accompanying drawings:

DESCRIPTION OF A PREFERRED EMBODIMENT

Figure 1:
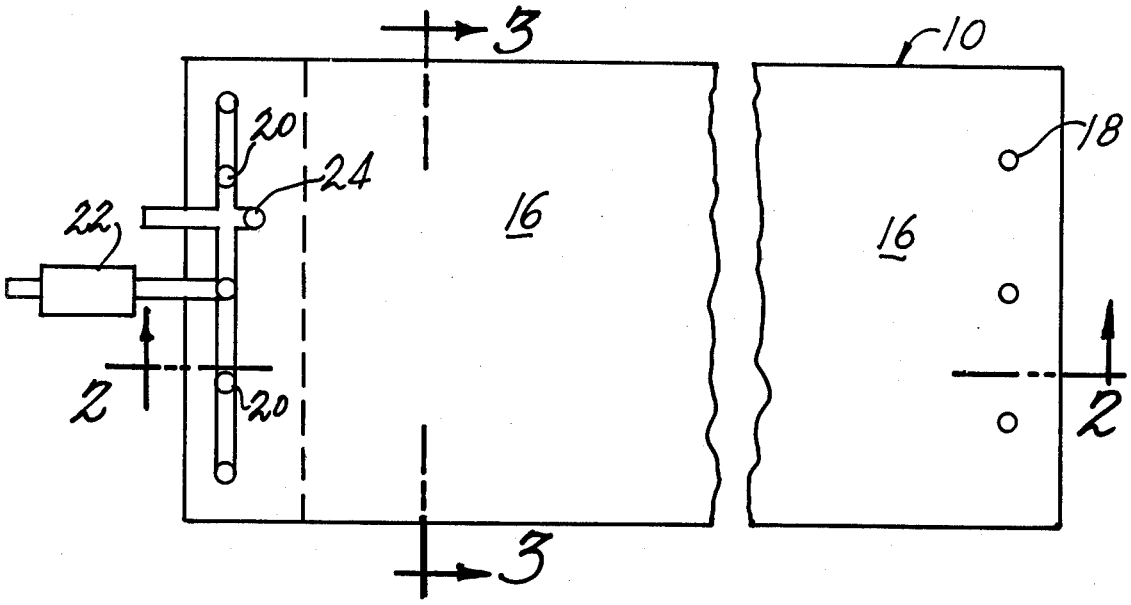
FIG. 1 is a diagrammatic schematic plan view of a longitudinally sloping trench for the retorting of oil shale.
Figure 2:
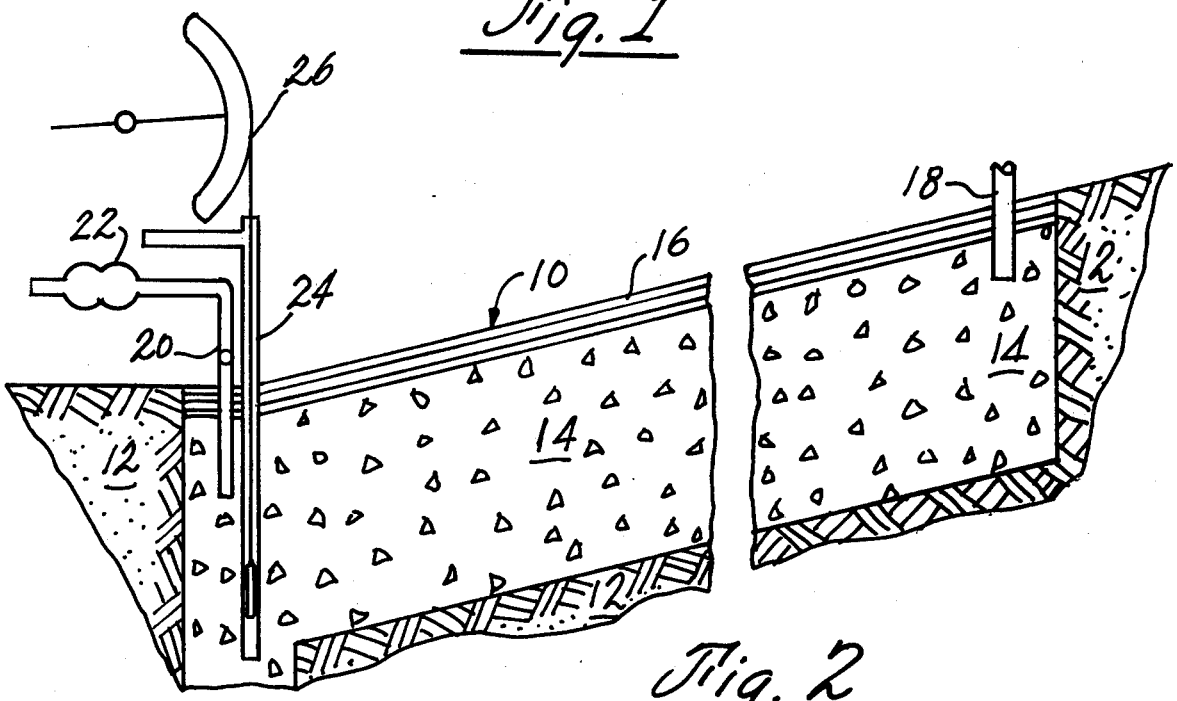
FIG. 2 is a diagrammatic schematic side elevation view of said trench taken substantially along lines 2—2 in FIG. 1.
Figure 3:
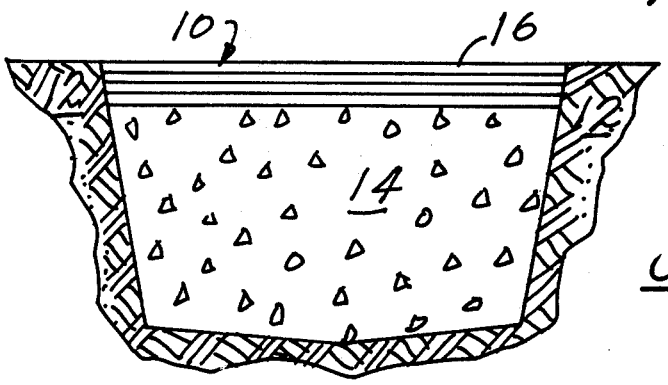
FIG. 3 is a diagrammatic schematic cross-section of said trench taken substantially along lines 3—3 in FIG. 1.
Figure 4:
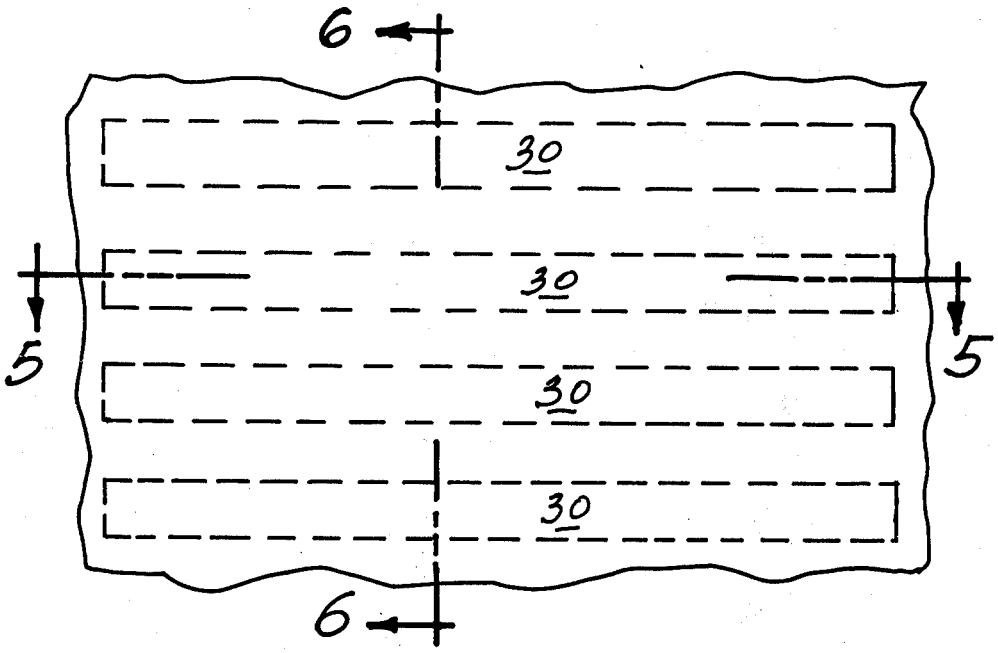
FIG. 4 is a diagrammatic schematic plan view of a first alternative embodiment of the invention starting with spaced tunnels in a natural deposit of oil shale.
Figure 5:
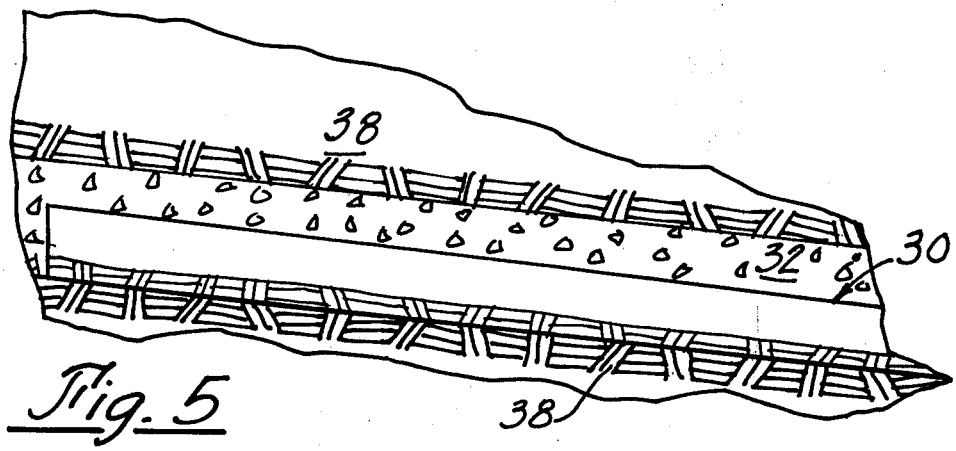
FIG. 5 is a cross-sectional view taken substantially along lines 5—5 in FIG. 4.
Figure 6:
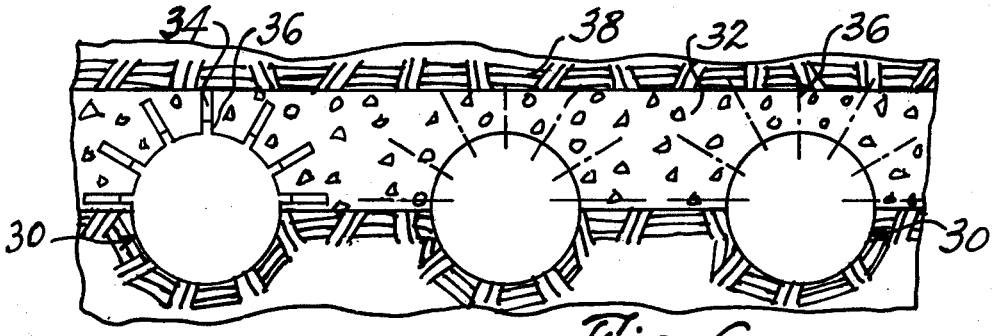
FIG. 6 is a cross-sectional view taken substantially along lines 6—6 in FIG. 4 but provided with blasting holes for blasting.

Referring to the drawings and particularly to the FIGS. 1 thru 3, inclusive, thereof, a trench 10 is excavated by means of any suitable and conventional excavating machinery to create a cavity in what is essentially impermeable soil or rock 12 which is thereafter filled with crushed oil shale 14 mined from the oil shale source and placed in the trench 10 to make a bed which is thereafter covered with a layer of substantially impermeable material such as clay 16. Air inlet pipes 18 are inserted at points located at the upper end of the trench 10 and gas withdrawal pipes 20 are inserted at points located at the lower end of the trench and connected to a suction pump 22. In addition, liquid withdrawal pipes 24 equipped with oil lifting pumps 26 are inserted at points located at the lower end of the trench which is filled with the crushed oil shale 14.

EXAMPLE

The bed of the crushed oil shale 14 is ignited through the pipes 18 and the combustion and retorting zones are caused to move toward the lower end of the trench by withdrawing the gaseous and liquid materials by suction pump 22 and the oil lifting pump 26 thru the pipes 20 and 24. As the combustion and retorting zones move toward the lower end of the trench 10, the crushed oil shale 14 in the trench 10 is retorted. The shale oil formed in retorting condenses on the unretorted shale and collects at the bottom of the trench 10, flows by gravity toward the lower end of the trench 10 where it is withdrawn by the oil lifting pump 26 and pumped to storage. The gaseous products formed in combustion and retorting of the oil shale 14 are also moved toward the lower end of the trench 10 and are withdrawn with suction pump 22 and sent further processing and/or use as fuel or chemical feedstock. As the hot liquid and gaseous products move toward the lower end of the trench, these are cooled on the surface of the unretorted oil shale causing pre-heating of same. Similarly, as the air moves from the air inlet pipe 18 toward the combustion zone it is pre-heated by the hot spent oil shale, said spent oil shale being cooled in the process.

Figure 7:
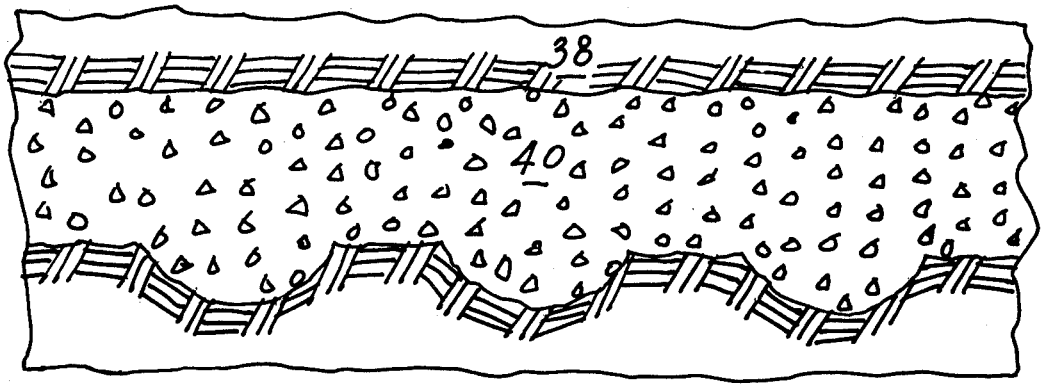
FIG. 7 is a diagrammatic schematic view similar to FIG. 6 but after the blasting has taken place.

In the embodiment of the invention which is illustrated in FIGS. 4 thru 8, inclusive, a plurality of spaced and independent sloping trenches or cavities are in the form of tunnels 30 which are tunneled into a natural deposit of oil shale 32 without removing the overburden and the trenches or tunnels 30 formed in this manner afterwards are filled with crushed oil shale by blasting the overlying oil shale 32 with explosives 34 packed into holes 36 drilled from the tunnels 30. Referring to FIGS. 4 thru 8, inclusive, the tunnels 30 are excavated along the sloping innerface between the oil shale 32 and relatively impermeable rock 38. Furthermore, the blasting holes 36 are drilled at intervals radially from the tunnels 30 and the blast holes 36 are packed with explosives and exploded in a predetermined sequence. As a result, the oil shale layer 32 is crushed and deposited in the now conneted tunnels 30 to form a wide continuous sloping trench filled with crushed oil shale 40 and covered with the relatively impermeable formation rock 38 as shown in FIG. 7 which represents the cross-section of the group of tunnels along lines 6—6 after the blasting.

Figure 8:
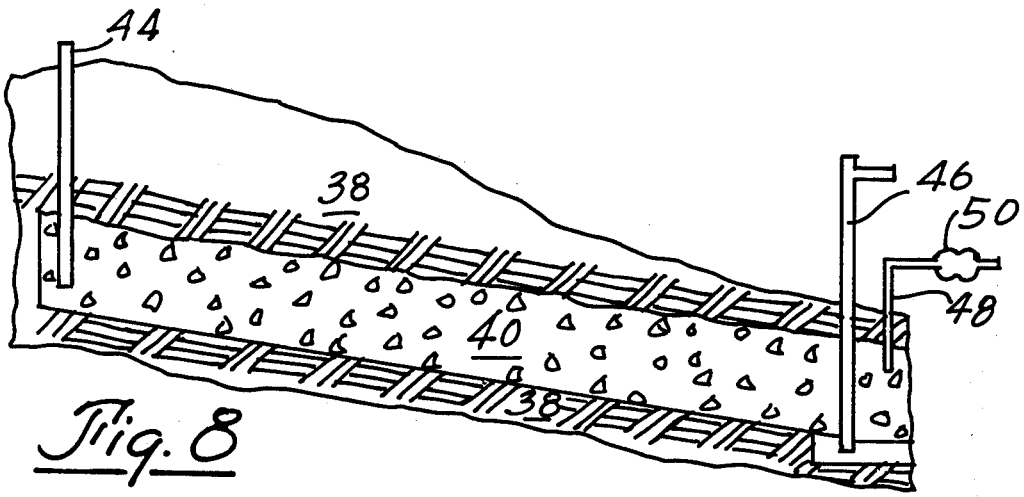
FIG. 8 is a diagrammatic schematic cross-sectional view similar to the view in FIG. 5 after the blasting shown in FIG. 6.

For retorting of the crushed oil shale 40, the longitudinally sloping trench which is filled with the crushed oil shale 40 is equipped, as shown in FIG. 8, with air inlet holes 44, oil lifting pipes 46, gas withdrawal pipes 48, and gas suction pump 50. As is readily seen, this arrangement resembles the one shown in FIGS. 1, 2 and 3, inclusive, and the actual retorting process is the same as the one described in the previous example 1.

Figure 9:
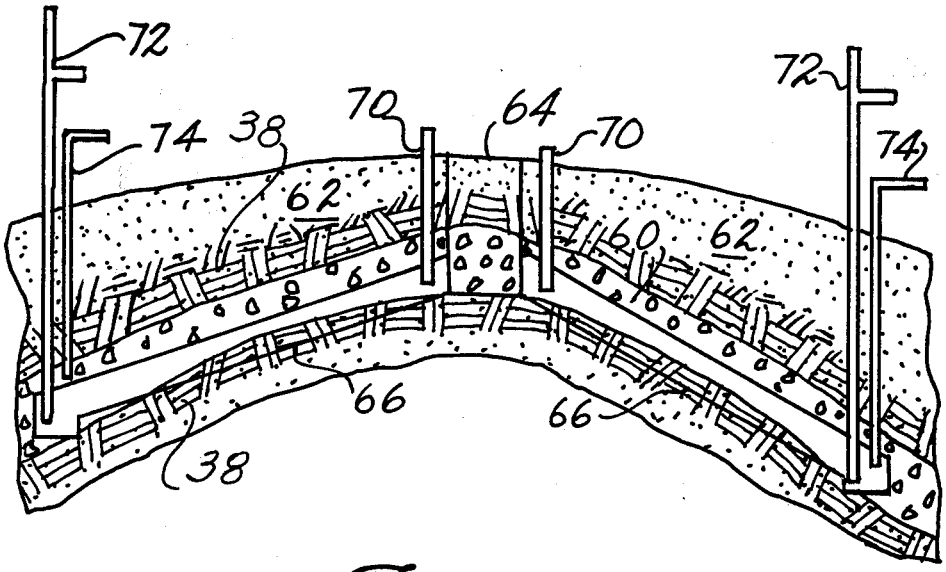
FIG. 9 is a diagrammatic schematic view illustrating the preparation and retorting of differently sloping and folded beds of oil shale inside elevation.

In FIG. 9, there is illustrated how this invention is adapted for preparing and retorting of differently sloping and folding beds of oil shale. FIG. 9 represents a highly simplified side elevation showing the arrangement for retorting of an uplifted layer of oil shale 60 covered with overburden 62. In this arrangement, a shaft 64 is sunk to the crown of oil shale layer 60, longitudinally sloping tunnels 66 are excavated from the shaft and the surrounding oil shale is blasted for the tunnels 66 to form longitudinally sloping wide trenches filled with crushed oil shale. For retorting, these trenches are equipped with air inlet pipes 70, oil lifting pipes 72, and gas suction pipes 74.

Referring to FIG. 2, the length of the trench 10, as measured along the incline and approximately along an imaginary longitudinal plane from left to right in the drawing, would not be less than approximately 5 times the depth thereof measured along an imaginary plane substantially perpendicular to the longitudinal plane. The inclination of the cavity 10 and the slope thereof along the longitudinal plane with respect to a horizontal plane is approximately between 1° and 45°.

EXAMPLE 2

A trench 10 is excavated approximately 200 yards long (as measured along the slope plane) and approximately 10 yards deep (as measured perpendicular to the slope plane).

While I have shown and described a particular method together with an illustration of how the method might be conducted and other methods and illustrations of how this invention may be practiced, this is by way of illustration only and does not constitute any sort of limitaton on the scope of my invention since various alterations, changes, deviations, eliminations, revisions and departures may be made in the embodiment shown without departing from the scope of my invention as defined in the appended Claims.

What is claimed is:

1. A method for recovering products from oil shale comprising the steps of: providing an enclosed sloping cavity by constructing said cavity as an open trench in a relatively impermeable mineral formation, placing crushed oil shale in said trench, covering said crushed oil shale with a relatively impermeable material, such as clay, igniting said oil shale at the upper portion of said trench, introducing a gaseous means such as air or oxygen for supporting combustion at one or more points located near the upper end of the enclosed trench, and as the products of the combustion and pyrolisis move downward in the sloping trench withdrawing any liquid and or gaseous material at one or more points located near the lower end of said trench.

2. The method claimed in claim 1: wherein the approximate length of the cavity is not less than about 5 times the depth thereof.

3. The method defined in claim 2: wherein the cavity is caused to slope at an angle from a horizontal plane of between approximately 1° and 45°.

4. The method claimed in claim 3: wherein the approximate length of the cavity is measured along a longitudinal plane substantially parallel to the plane of the slope of said cavity and the depth thereof is measured along a plane perpendicular to said longitudinal plane.

5. The method in claim 1 including: providing a tunnel in oil shale by removing shale therefrom and thereafter placing said shale in the trench.

6. The method in claim 5 including: causing one or more explosions in the tunnel to create crushed shale in said tunnel.

7. A method for recovering products from oil shale comprising the steps of: providing at least one tunnel in oil shale by removing the oil shale to make the tunnel, thereafter causing the oil shale to detach from the surrounding walls in said tunnel by causing one or more explosions in said tunnel to create additional crushed shale in the tunnel, providing an open sloping trench in a relatively impermeable mineral formation, placing the oil shale removed in the process of forming the tunnel in the open trench, covering said oil shale with relatively impermeable material such as clay, igniting said oil shale at the upper portion of said trench, introducing a gaseous means such as air or oxygen for supporting combustion at one or more points located near the end of the trench, and as the products of the combustion and pyrolisis move downward in the sloping trench withdrawing any liquid and/or gaseous material at one or more points located near the end of said trench.

8. A method for recovering products from oil shale and relatively impervious material such as rock comprising the steps of: providing a plurality of tunnels in the oil shale, causing the oil shale to detach from the surrounding walls in said tunnels and creating a sloping cavity having the crushed shale therein, igniting said oil shale at the upper portion of said cavity, introducing a gaseous means such as air or oxygen for supporting combustion at one or more points located near the upper end of enclosed cavity, and as the products of the combustion and pyrolisis move downward in the sloping cavity withdrawing any liquid and/or gaseous material at one or more points located near the lower end of said cavity.

9. The method in claim 8 including: causing one or more explosions in said tunnels to create the crushed shale.

10. The method claimed in claim 8 including: providing a plurality of closely adjacent tunnels so that the exploding thereof provides substantially a wide continuous longitudinally sloping layer which has the crushed oil shale therein which is covered with a relatively impermeable formation.

11. The method claimed in claim 8 including: forming the tunnels in a natural deposit of oil shale without removing the overburden and thereafter filling the tunnels with crushed oil shale by exploding the surrounding naturally deposited oil shale layer whereby the covering of the tunnels is by means of the naturally deposited overburden.

12. The method claimed in claim 8 including blasting the oil shale at intervals in said tunnels to create the crushed shale therein.

13. The method in claim 8 wherein said tunnels are provided and the cavity created without removing the natural overburden whereby the cavity is covered by the natural overburden.

14. The method in claim 8 including excavating said tunnels in close relationship and thereafter causing an explosion which produces a substantially wide and continuous cavity having the crushed oil shale therein covered with a relatively impermeable formation.

15. The method claimed in claim 8 including constructing an open, sloping trench in a relatively impermeable mineral formation, removing and crushing some of the oil shale from said tunnels in providing said tunnels, placing the oil shale which is removed from said tunnels in said sloping trench, covering said crushed oil shale with a relatively impermeable material, such as clay, igniting said oil shale in the upper portion of said trench and thereafter collecting and withdrawing any liquid and/or gaseous material.

* * * * *